US011566395B2

(12) United States Patent
Cropper et al.

(10) Patent No.: US 11,566,395 B2
(45) Date of Patent: Jan. 31, 2023

(54) METHOD AND APPARATUS FOR FINISHING WALLS

(71) Applicants: Peter John Cropper, Red Hill (AU); Steven Thomas Cropper, Red Hill (AU)

(72) Inventors: Peter John Cropper, Red Hill (AU); Steven Thomas Cropper, Red Hill (AU)

( * ) Notice: Subject to any disclaimer, the term of this patent is extended or adjusted under 35 U.S.C. 154(b) by 0 days.

(21) Appl. No.: 17/132,256

(22) Filed: Dec. 23, 2020

(65) Prior Publication Data

US 2021/0189681 A1 Jun. 24, 2021

(30) Foreign Application Priority Data

Dec. 24, 2019 (AU) ..... 2019904944

(51) Int. Cl.
*E02D 29/02* (2006.01)
*E04H 17/00* (2006.01)

(52) U.S. Cl.
CPC ..... *E02D 29/0266* (2013.01); *E04H 17/00* (2013.01)

(58) Field of Classification Search
CPC . E02D 29/0266; E02D 29/025; E04H 17/006; E04H 17/168; E04B 2002/742
See application file for complete search history.

(56) References Cited

U.S. PATENT DOCUMENTS 4,306,631 A * 12/1981 Reusser ..... E01F 8/0035 181/210
4,674,593 A * 6/1987 McCarty ..... E01F 8/0011 181/210
5,136,821 A * 8/1992 Child ..... E01F 8/0058 181/290
5,671,913 A * 9/1997 Vesper ..... E04H 17/168 256/31
6,088,980 A * 7/2000 Gulliver ..... E04B 2/7425 403/293
8,616,331 B2 * 12/2013 Humphries ..... E01F 8/0023 181/286
2002/0125467 A1 * 9/2002 Erwin ..... E04H 17/16 256/1
2004/0020144 A1 * 2/2004 Sanders ..... E04C 1/395 52/223.7
2009/0269145 A1 * 10/2009 Castle ..... E02D 5/64 405/232
2017/0167162 A1 * 6/2017 Martin ..... B32B 9/002

* cited by examiner

*Primary Examiner* — Carib A Oquendo
(74) *Attorney, Agent, or Firm* — Tumey L.L.P.

(57) ABSTRACT

A finishing assembly for a rail and post wall comprising: one or elongate capping members having longitudinal recesses for receiving a top of the wall and for installation therealong; and one or more post covers for installation over posts of the wall.

13 Claims, 8 Drawing Sheets

METHOD AND APPARATUS FOR FINISHING WALLS

TECHNICAL FIELD

The present invention relates to a method and apparatus for finishing walls and in particularly for finishing external walls such as retaining walls.

BACKGROUND

Any references to methods, apparatus or documents of the prior art are not to be taken as constituting any evidence or admission that they formed, or form part of the common general knowledge.

One type of external wall that is commonly used in landscaping applications is a post and rail retaining wall. FIG. 1 depicts a portion of a typical post and rail retaining wall 1 in isometric view whereas FIG. 2 is a side view of the wall 1. Wall 1 is comprised of posts 3*a*, 3*b*, 3*c* which typically extend vertically from concrete footings in the ground 5. The posts are usually of an "H" profile, as shown in the figures with end posts typically having a "U" channel profile.

An "H" profile post 3*b* is shown in FIG. 3 alongside "U" channel profile post 3*c*. The "H" profile post 3*b* is comprised of opposed flanges 7*a*, 7*b* with a web interconnecting them. Accordingly, the "H" profile post 3*b* defines opposed spaces 9*a*, 9*b*, each of width W, for receiving ends of rails in the form of sleepers 11. As can be seen in FIGS. 1 and 2, a first column 11*a* of six sleepers 11 is located between posts 3*a* and 3*b* and a second column 11*b* of five sleepers 11 is located between posts 3*b* and 3*c*.

The edges of the sleepers 11, whether the sleeper is made of concrete or of timber, can be quite rough which implies that the upper edges of the wall is rough. Furthermore, where the wall 1 is stepped, as occurs when adjacent columns of sleepers are of different heights then a portion of space 9*a* of a post will be exposed. For example, in FIG. 1 it will be observed that space 9*a* of post 3*b* is exposed, which may present a point of potential injury.

Apart from safety issues, it would also be advantageous if the wall was visually more appealing, i.e. if it had an improved finished appearance over that shown in FIG. 1 for example.

It is an object of the present invention to address the issues that have been discussed.

SUMMARY OF THE INVENTION

According to a first aspect of the present invention there is provided a method for finishing a post and rail wall comprising:

installing elongate capping members along the wall, wherein the elongate capping members are formed with a longitudinal recess for receiving a top of the wall.

In an embodiment the method further includes installing covers over posts of said wall.

Preferably upper ends of the posts abut underside portions of the capping members.

Preferably a thickness of the covers corresponds to a width of the underside portions of the capping members.

In a preferred embodiment the elongate members are formed with first and second opposed margins on either side of the longitudinal recess for respective placement on inner and outer sides of the wall.

Preferably the first margin, is wider than the second margin. Preferably the first margin is of a width corresponding to a thickness of the covers.

In an embodiment the method further includes installing post-side face members into exposed portions of posts of the wall.

In a preferred embodiment the method includes making miter joins between ends of the post side face members and adjacent ends of the capping members.

In an embodiment the method includes applying adhesives between the elongate capping members and the wall.

The method may include applying an adhesive to attach the covers to the wall.

The method may include applying gap fillers between one or more of the elongate capping members, the post-side face members, the post covers and the wall.

In an embodiment one or more of the elongate capping members, post covers and post-side face members are made of polystyrene which is sand and urethane coated.

In an embodiment one or more of the elongate capping members, post covers and post-side face members are made of PVC.

According to another aspect of the present invention there is provided a finishing assembly for a rail and post wall comprising:

one or elongate capping members having longitudinal recesses for receiving a top of the wall and for installation therealong; and one or more post covers for installation over posts of the wall.

In a preferred embodiment the finishing assembly includes one or more post-side face members.

Preferably the post-side face member includes a longitudinal ridge for insertion between flanges of a post of the wall.

Preferably the post-side face member includes lateral shoulders extending from opposed sides of the longitudinal ridge.

BRIEF DESCRIPTION OF THE DRAWINGS

Preferred features, embodiments and variations of the invention may be discerned from the following Detailed Description which provides sufficient information for those skilled in the art to perform the invention. The Detailed Description is not to be regarded as limiting the scope of the preceding Summary of the Invention in any way. The Detailed Description will make reference to a number of drawings as follows.

DETAILED DESCRIPTION OF PREFERRED EMBODIMENTS

Figure 4:
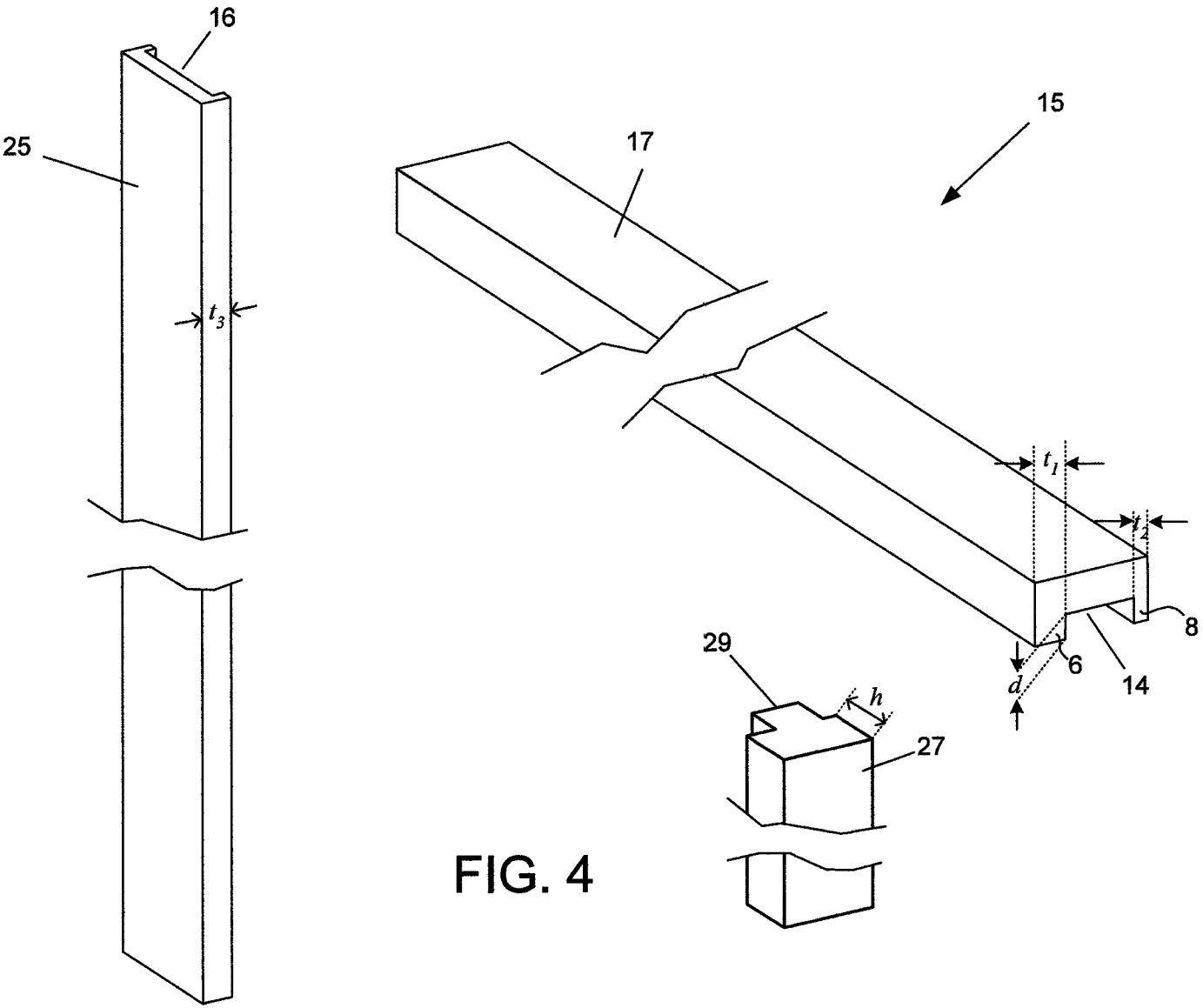
FIG. 4 depicts a finishing assembly for a post and whaler wall.

FIG. 4 depicts a finishing assembly 15 for a post and whaler wall such as post and whaler wall 1, in a preferred embodiment. Such a wall typically comprises steel posts between which there are columns of concrete sleepers or in some cases timber sleepers.

The finishing assembly 15 includes at least one elongate capping member 17, having a longitudinal recess or groove 14 for receiving a top 23 of the wall 1 and for installation therealong. Opposed longitudinal walls 6, 8 extend along either side of groove 14 and have respective wall thickness of t1 and t2.

Figure 1:
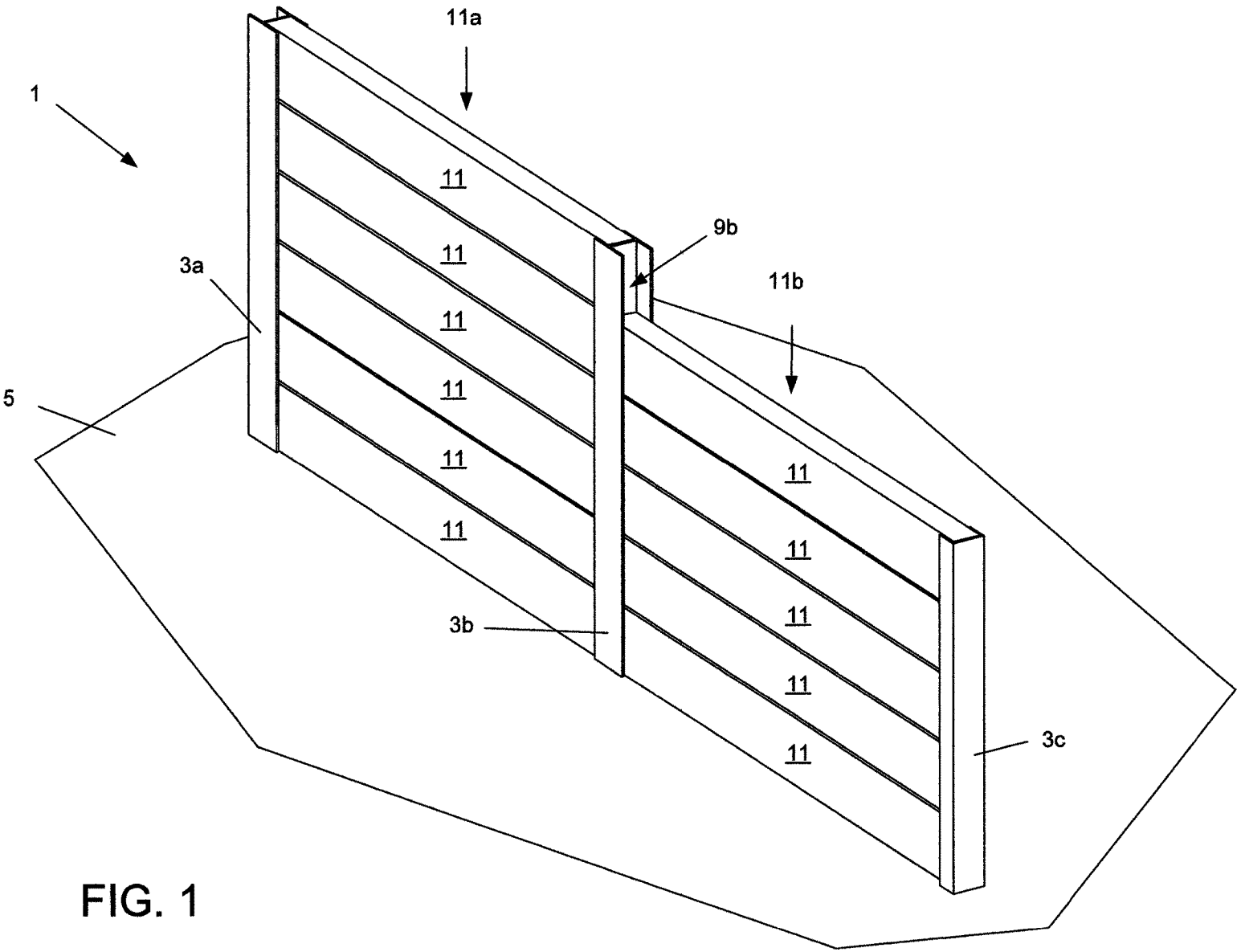
FIG. 1 is an isometric view of a prior art post and whaler wall.
Figure 2:
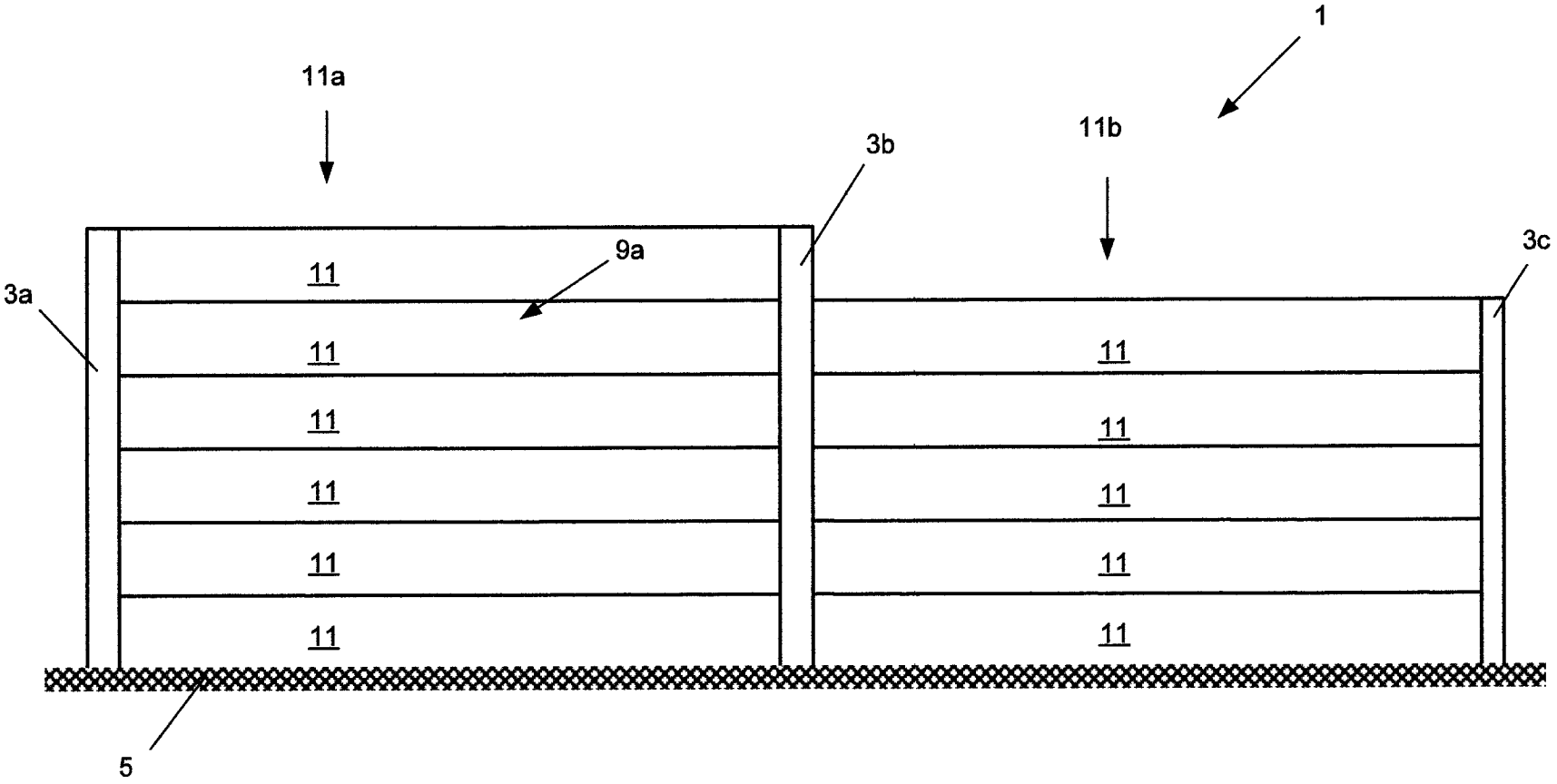
FIG. 2 is a side view of the wall of FIG. 1.
Figure 3:
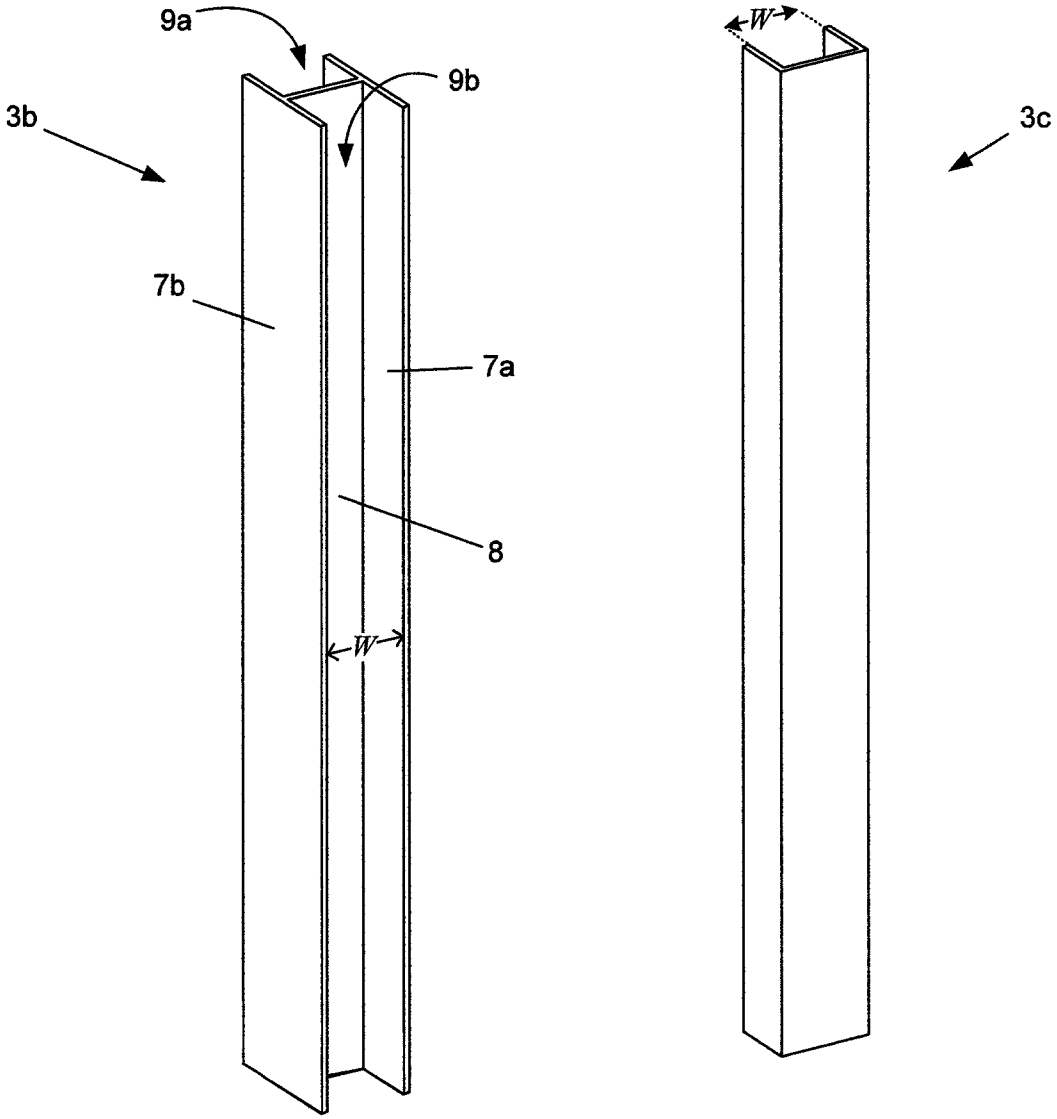
FIG. 3 comprises isometric views of "H" and "U" channel posts of the wall of FIG. 1.

The finishing assembly 15 also includes at least one post cover member 25 which is formed with a longitudinal recess 16 along an inner side that is dimensioned to locate over an outer flange of the posts 3, for example flange 7*b*, of the post 3*b* as illustrated in FIG. 3. Post cover member 25 has a thickness t3. The thickness t1 of wall 6 of the elongate capping member 17 is a little greater than t3 so that the capping members overhang the post covers once installed.

The finishing assembly 15 also includes at least one post-side face member 27 for placement down the side of step-space 9*b* of post 3*b*.

Each post-side face member 27 includes a longitudinal tongue 29 that has width which is less than the width W of inter-flange spaces 9*a*, 9*b* and which is also less than the width of groove 14 of elongate capping member 17.

Figure 5:
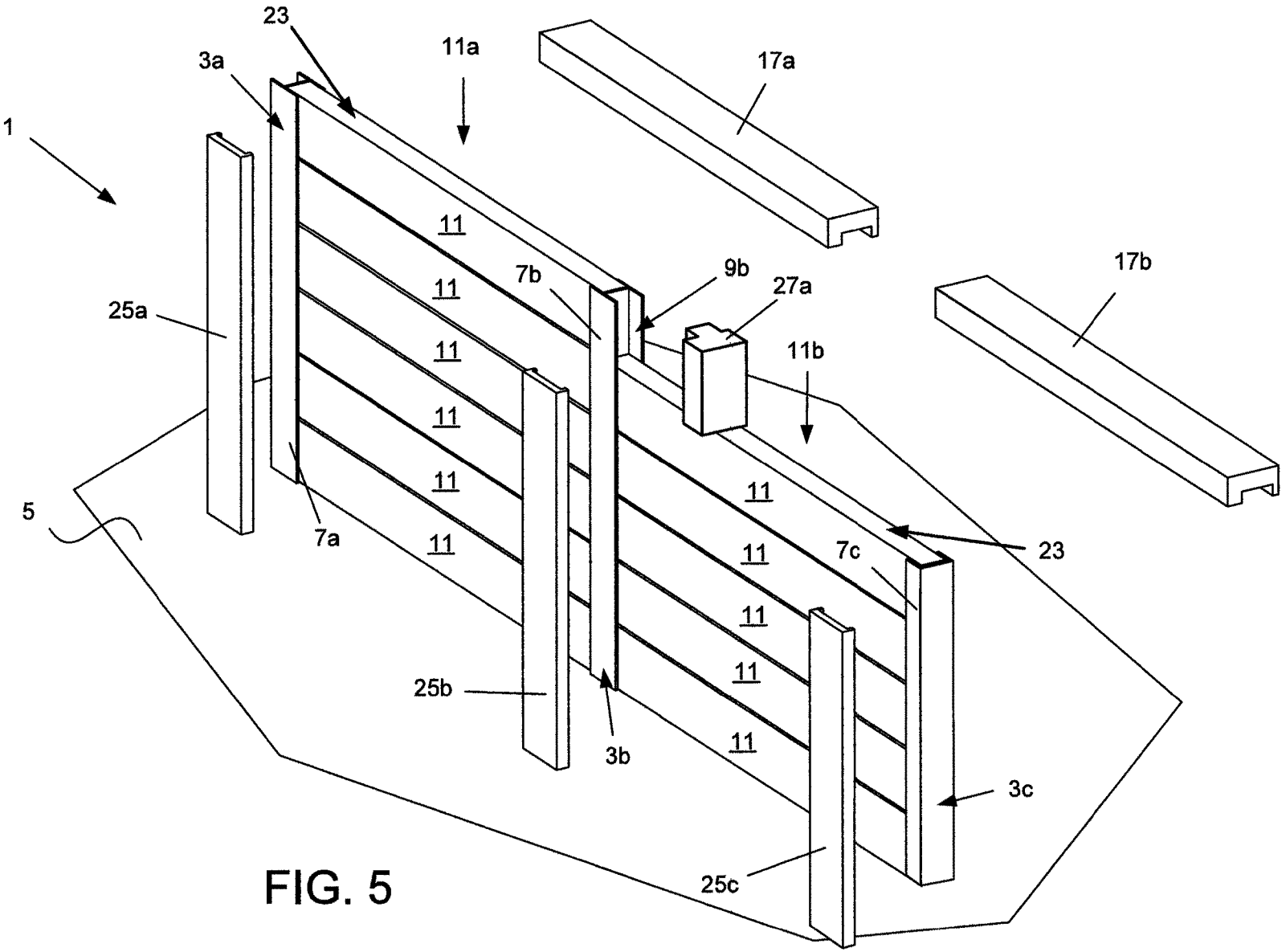
FIG. 5 shows the finishing assembly in a first stage of installation.

In use the elongate capping member 17, post cover member 25 and post-face member 27 are cut into pieces for installing to fence 1. Referring now to FIG. 5, the elongate capping member 17 is cut to form two pieces 17*a*, and 17*b*. Piece 17*a* is sufficiently long to be placed over the top of post 17*a*, over the top of sleeper column 11*a* and over the top of post 9*b* with an overhang over the top of post 9*b* a distance that corresponds to the thickness h of the non-tongue portion of the post-side face member 27 as indicated in FIG. 4. As will be explained, the overhang is for the purpose of making a miter joint between the overhanging end of the elongate capping member 17*a* and the upper end of the post-side face member 27*a*. The cover member 25 is cut to provide three post cover members 25*a*, 25*b* and 25*c* for respectively covering outer flanges 7*a*, 7*b* and 7*c* of posts 3*a*, 3*b* and 3*c*. The cover members 25*a*, 25*b* and 25*c* are approximately the length of each of the respective posts 3*a*, 3*b*, 3*c* though a little shorter by a distance d, indicated in FIG. 4, to accommodate the sides of the capping members 17*a*, 17*b* when they are fitted over the uppermost sleepers 11 and the upper ends of the posts 3*a*, 3*b*, 3*c* of the wall 1.

Figure 6:
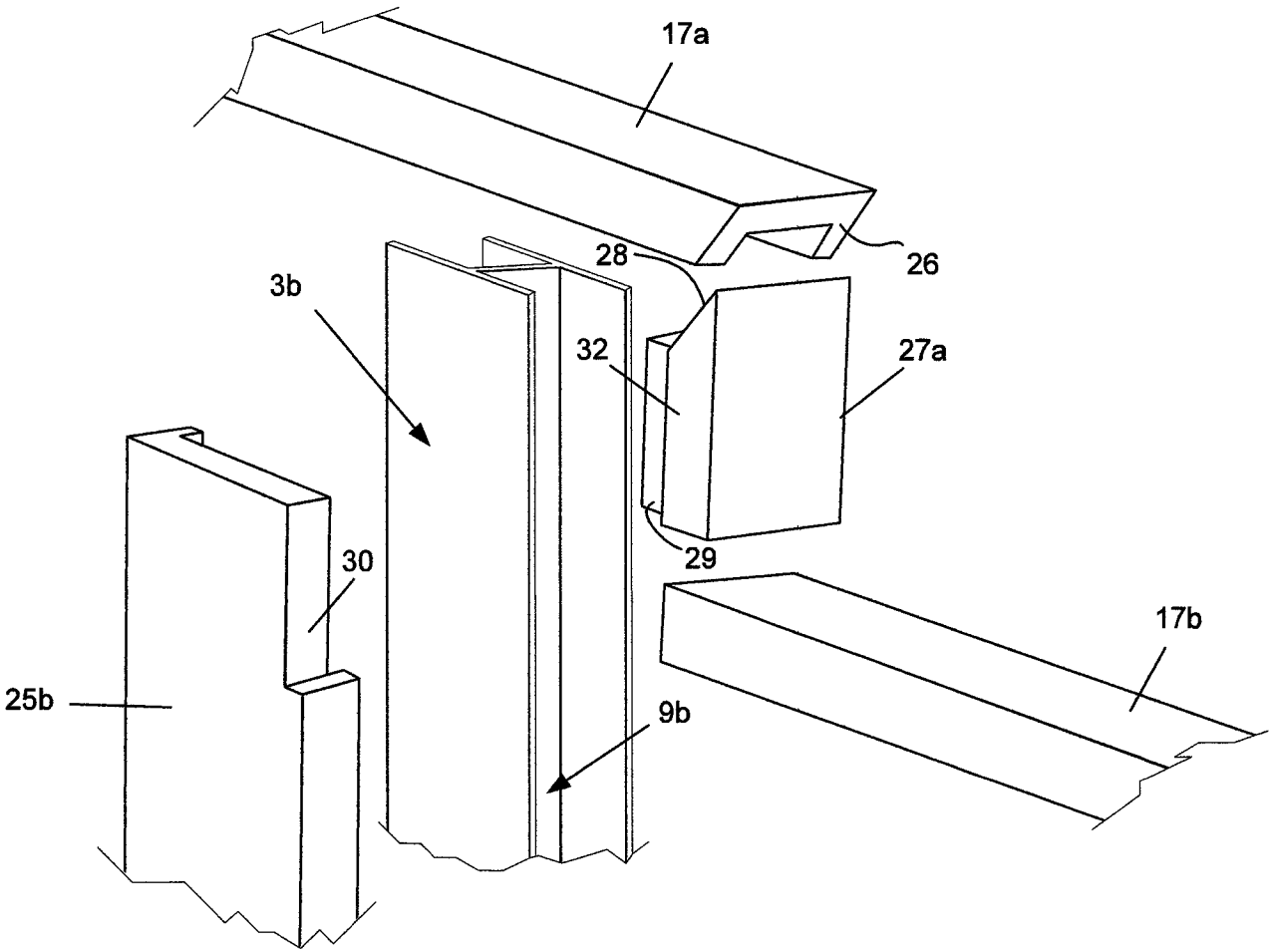
FIG. 6 is a detail of parts of the finishing assembly in a further stage of installation.

FIG. 6 illustrates a detail of a further stage in the installation of the finishing assembly wherein complementary miter cuts 26 and 28 have been made to the ends of the elongate capping member 17 and post face member 27. A cutout 30 has also been made down a side of the cover member 25*b* to accommodate portion 32 of the post face member 27.

Figure 7:
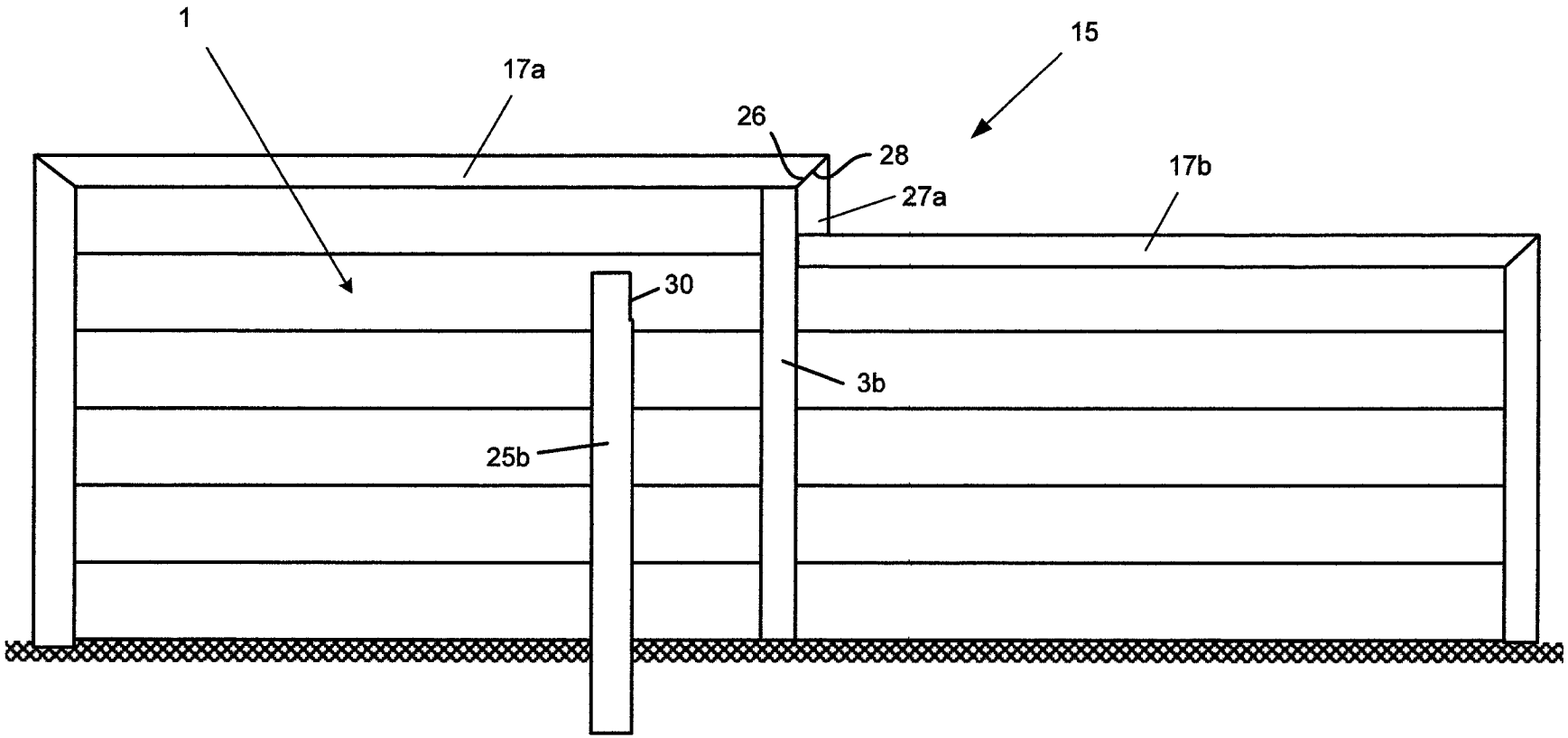
FIG. 7 is a side view of a wall with the finishing assembly installed thereto prior to placement of a post cover member.
Figure 8:
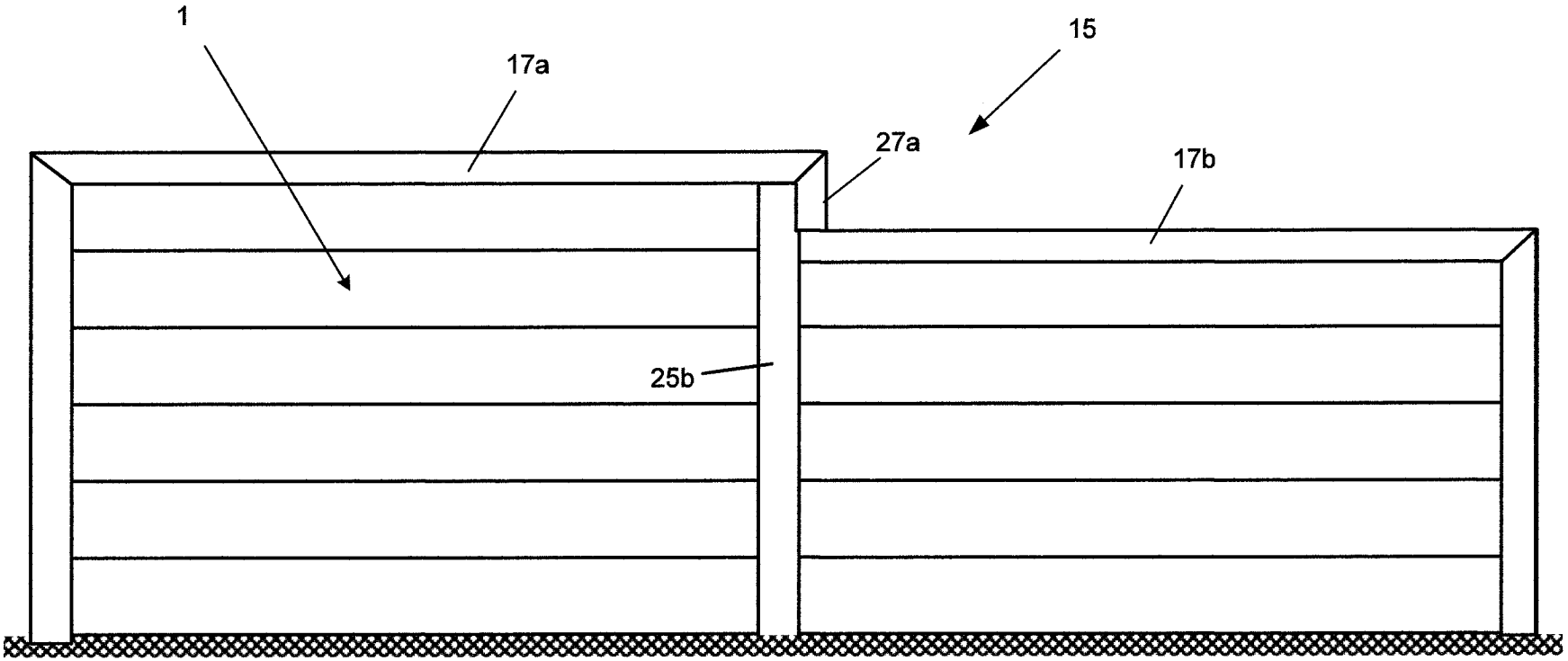
FIG. 8 is a subsequent view of the wall of FIG. 7 with the post cover member in place.

FIG. 7 is a side view of the wall with the finishing assembly installed thereto prior to placement of post cover member 25*b*. FIG. 8 is a subsequent view of the wall of FIG. 7 with the post cover member 25*b* in place.

During installation an adhesive may be applied between the elongate capping members 17*a*, 17*b* and the wall 1 for retaining the capping members 17. Similarly, the method may involve applying an adhesive to attach the covers to the wall.

Gap fillers can also be applied between one or more of the elongate capping members, the post-side face members, the post covers 17*a*, 17*b* and the wall 1. For example SIKA Boom expanding polyurethane foam from Sika may used.

The elongate capping members, post covers and post-side face members may be made of polystyrene which is sand and urethane coated. Preferably H grade polystyrene is used with a density of 24 kg per cubic meter. In another embodiment one or more of the elongate capping members, post covers and post-side face members are made of PVC.

It will therefore be appreciated that a post and whaler fence, when finished in the preferred manner that has been described, is safer than an unfinished fence since the rough sleeper top edges, post tops and exposed post side portions are covered. Even a minimal installation, according to a less preferred embodiment, wherein only the elongate capping members are installed, is an improvement that addresses the problem of the otherwise exposed sleeper edges.

In compliance with the statute, the invention has been described in language more or less specific to structural or methodical features. The term "comprises" and its variations, such as "comprising" and "comprised of" is used throughout in an inclusive sense and not to the exclusion of any additional features.

It is to be understood that the invention is not limited to specific features shown or described since the means herein described comprises preferred forms of putting the invention into effect. The invention is, therefore, claimed in any of its forms or modifications within the proper scope of the appended claims appropriately interpreted by those skilled in the art.

Throughout the specification and claims (if present), unless the context requires otherwise, the term "substantially" or "about" will be understood to not be limited to the value for the range qualified by the terms.

Any embodiment of the invention is meant to be illustrative only and is not meant to be limiting to the invention. Therefore, it should be appreciated that various other changes and modifications can be made to any embodiment described without departing from the spirit and scope of the invention.

What is claimed is:

1. A method for finishing a post and rail wall formed from spaced apart vertically extending posts with rows of horizontally oriented sleeper rails being positioned between the spaced apart vertically extending posts to form said wall with opposite ends of the sleepers being received in respective opposed spaces defined by the spaced apart vertically extending posts, the method comprising:

installing elongate capping members along the wall, wherein the elongate capping members are formed with a longitudinal recess for receiving a thickness of the sleeper rails forming a top of the wall;

installing covers over vertical side face of the posts wherein a thickness of the covers corresponds to a width of underside portions of the capping members, wherein upper ends of the posts abut the underside portions of the capping members.

2. The method in accordance with claim 1 wherein the elongate capping members are formed with first and second opposed margins on either side of the longitudinal recess for respective placement on inner and outer sides of the wall.

3. The method in accordance with claim 2 wherein the first margin, is wider than the second margin and wherein the first margin is of a width corresponding to a thickness of the covers.

4. The method in accordance with claim 1 further comprising the step of installing post-side face members into exposed portions of posts of the wall.

5. The method in accordance with claim 4 further comprising the step of making miter joins between ends of the post side face members and adjacent ends of the capping members.

6. The method in accordance with claim 1 further comprising the step of applying adhesives between the elongate capping members and the wall.

7. The method in accordance with claim 1 further comprising the step of applying an adhesive to attach the covers to the wall.

8. The method in accordance with claim 1 further comprising the step of installing post-side face members into exposed portions of posts of the wall.

9. The method in accordance with claim 8 further comprising the step of applying gap fillers between one or more of the elongate capping members, the post-side face members, the post covers and the wall.

10. The method in accordance with claim 9 wherein one or more of the elongate capping members, post covers and post-side face members are made of polystyrene which is sand and urethane coated.

11. The method in accordance with claim 10 wherein the elongate capping members, post covers and post-side face members are made of PVC.

12. A finishing assembly for a rail and post wall comprising:

one or more elongate capping members having longitudinal recesses for receiving a top of the wall and for installation therealong; and one or more post covers for installation over posts of the wall;

wherein the finishing assembly includes one or more post-side face members;

wherein the post-side face member includes a longitudinal ridge for insertion between flanges of a post of the wall.

13. A finishing assembly in accordance with claim 12 wherein the post-side face member includes lateral shoulders extending from opposed sides of the longitudinal ridge.

* * * * *